US009405305B1

(12) United States Patent
Zanchi

(10) Patent No.: US 9,405,305 B1
(45) Date of Patent: Aug. 2, 2016

(54) PRECISION VOLTAGE REFERENCE CIRCUIT WITH TUNABLE RESISTANCE

(71) Applicant: THE BOEING COMPANY, Huntington Beach, CA (US)

(72) Inventor: Alfio Zanchi, Huntington Beach, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 14/733,089

(22) Filed: Jun. 8, 2015

(51) Int. Cl.
*G05F 3/02* (2006.01)
*G05F 1/10* (2006.01)
*G05F 1/44* (2006.01)

(52) U.S. Cl.
CPC ..... *G05F 1/44* (2013.01)

(58) Field of Classification Search
CPC ..... G05F 1/465; G05F 1/56; G05F 1/575; G05F 3/30; G05F 3/267; G05F 3/262; G05F 3/205; G11C 5/147
USPC ..... 327/538, 540, 541
See application file for complete search history.

(56) References Cited

U.S. PATENT DOCUMENTS

2009/0309569 A1* 12/2009 Schulz ..... 323/313
2013/0314068 A1* 11/2013 Zhen et al. ..... 323/313

OTHER PUBLICATIONS

Ahuja, B. et al., A Very High Precision 500-nA CMOS Floating-Gate Analog Voltage Reference, IEEE Journal of Solid-State Circuits, Dec. 2005, pp. 2364-2372, vol. 40, No. 12.
Brokaw, A., A Simple Three-Terminal IC Bandgap Reference, IEEE Journal of Solid-State Circuits, Dec. 1974, pp. 388-393, vol. SC-9, No. 6.
Widlar, R., New Developments in IC Voltage Regulators, IEEE Journal of Solid-State Circuits, Feb. 1971, pp. 2-7, vol. SC-6, No. 1.

* cited by examiner

*Primary Examiner* — Quan Tra
(74) *Attorney, Agent, or Firm* — Armstrong Teasdale LLP

(57) ABSTRACT

A voltage reference circuit is provided. A voltage reference circuit includes a bridge circuit having a first branch, a second branch, and an amplifier. The bridge circuit is coupled between a precision voltage reference (PVR) node and a ground node. The first branch includes a first resistor of value R1 coupled to a reference resistor of value Rref at a first intermediate node. The second branch includes a second resistor of value R1 coupled to a variable resistor of value Rvar at a second intermediate node. Rvar is non-linearly tunable based on the PVR. The amplifier includes a positive input terminal coupled to the second intermediate node and a negative input terminal coupled to the first intermediate node. The amplifier is configured to generate the PVR.

20 Claims, 10 Drawing Sheets

PRECISION VOLTAGE REFERENCE CIRCUIT WITH TUNABLE RESISTANCE

BACKGROUND

The field of the disclosure relates generally to precision voltage reference circuits, and more specifically to a precision voltage reference circuit having a tunable switched capacitor resistance.

Many electrical systems, including, for example, control systems and measurement devices, rely on a voltage reference for some aspect of operation. In certain applications, such as long-range guided vehicles, a precision voltage reference (PVR) is critical, because even small shifts in the voltage reference translate to errors in acceleration, position, and rotation. Some vehicles, such as intercontinental missiles and space vehicles, for example, use inertial pendulum-based navigation systems, gyroscopic based navigation systems, or some combination of both to satisfy their low tolerance for error in precision and accuracy. Such systems often require a PVR with stability on the order of 1 part-per-million (ppm) over age, temperature variation, and radiation events.

BRIEF DESCRIPTION

According to one aspect of the present disclosure, a voltage reference circuit is provided. A voltage reference circuit includes a bridge circuit having a first branch, a second branch, and an amplifier. The bridge circuit is coupled between a precision voltage reference (PVR) node and a ground node. The first branch includes a first resistor of value R1 coupled to a reference resistor of value Rref at a first intermediate node. The second branch includes a second resistor of value R1 coupled to a variable resistor of value Rvar at a second intermediate node. Rvar is non-linearly tunable based on the PVR. The amplifier includes a positive input terminal coupled to the second intermediate node and a negative input terminal coupled to the first intermediate node. The amplifier is configured to generate the PVR.

According to another aspect of the present disclosure, a method of generating a precision voltage reference (PVR) is provided. The method includes generating a startup voltage for a bridge circuit coupled between the PVR and ground. The method further includes comparing voltages at intermediate nodes of a first branch and a second branch of the bridge circuit to generate the PVR. The method further includes tuning a switched capacitor resistor in the second branch using at least one of a variable frequency control signal and a variable capacitance. The tuning is based on the PVR.

The features, functions, and advantages that have been discussed can be achieved independently in various embodiments or may be combined in yet other embodiments further details of which can be seen with reference to the following description and drawings.

DETAILED DESCRIPTION

Figure 1:
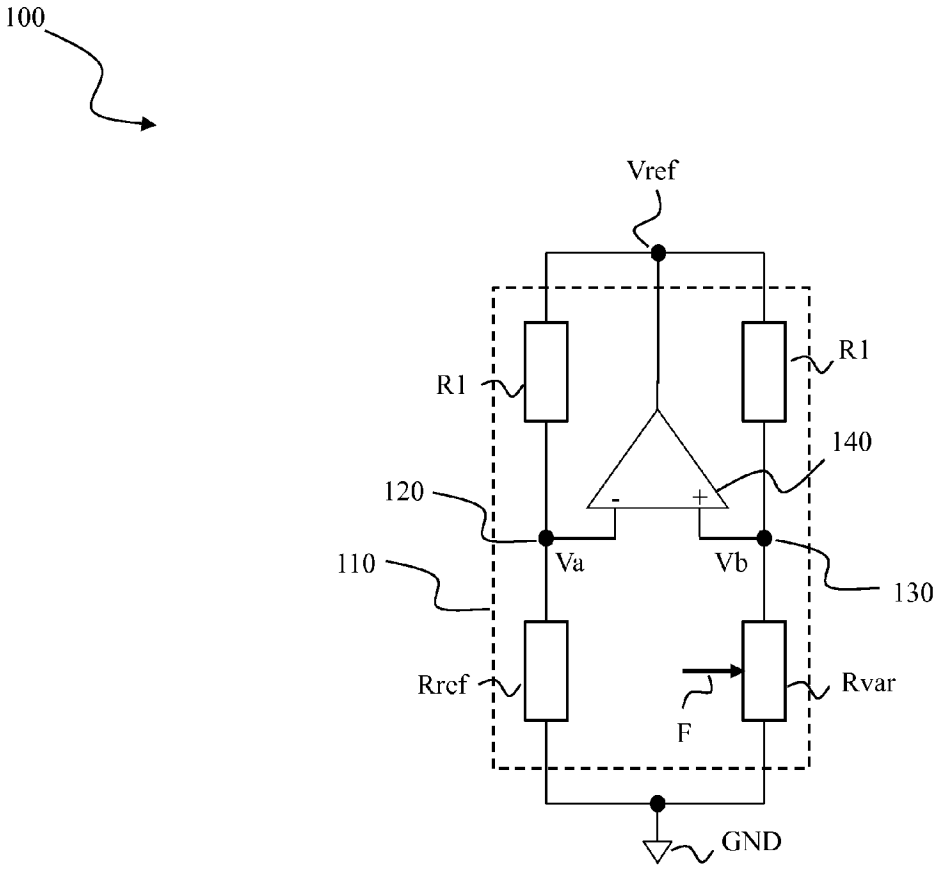
FIG. 1 is a schematic diagram of one embodiment of a voltage reference circuit.

As used herein, an element or step recited in the singular and preceded by the word "a" or "an" should be understood as not excluding plural elements or steps unless such exclusion is explicitly recited. Furthermore, references to "one embodiment" of the present invention or the "exemplary embodiment" are not intended to be interpreted as excluding the existence of additional embodiments that also incorporate the recited features.

In some systems, a PVR source is realized through mechanical apparatuses that are typically bulky, low-precision, and consume a lot of power. Other systems use electronic bandgap reference circuits that are typically noisy and sensitive to radiation. Bandgap reference circuits generally include forward-biased semiconductor p-n junctions that are known to shift with exposure to radiation. Such bandgap reference circuits can achieve as low as 5 ppm per degree C. stability in a tightly controlled environment, when complemented with high-order curvature compensation ancillary circuits. However, practically, certain physical phenomena during operation of the bandgap circuit are subject to shifts on the order of 1000 ppm per degree C., which complicates achieving that 5 ppm per degree C. stability upon exogenous events, such as, for example, radiation doses. Certain other applications for PVR, such as signal sensing and pre-conditioning, analog to digital conversion, digital to analog conversion, battery supervision, and laser diode drivers, for example, can achieve 1 ppm per degree C. using low-voltage circuits and special tunnel diodes, but use costly non-standard semiconductor technology and are still sensitive to radiation. It is realized herein that the precision and reliability of existing PVR circuits is desirable. It is further realized herein that a PVR circuit can be constructed that is temperature and radiation stable to at least 1 ppm using a tunable resistance.

Thus, exemplary embodiments may provide a voltage reference circuit configured to generate a PVR that is temperature- and radiation-stable. More specifically, exemplary voltage reference circuits include a bridge circuit that includes an amplifier that self-references, which eliminates dependencies of the PVR from the supply. Some exemplary bridge circuits include a variable resistor configured to be monotonically tuned by the PVR. Some exemplary bridge circuits include a switched capacitor resistor that is configured to be tuned by at least one of a variable frequency control signal and a variable capacitance. Embodiments utilizing a variable frequency control signal generate the variable frequency signal using a voltage controlled oscillator (VCO) that is configured to be tuned based on the PVR. Certain VCOs, such as a relaxation VCO and a differential L-C tank VCO, can be implemented to be particularly temperature-stable and radiation-stable. Embodiments utilizing a variable capacitance, or varactor, tune the capacitance based on the PVR. Certain varactors, such as a MOS varactor, a MOSFET capacitor, and a MEMS varactor, can also be implemented to be temperature- and radiation-stable.

In certain embodiments, the variable frequency control signal is paired with a fixed capacitance. Such embodiments fall into a first class of embodiments. In other embodiments, a variable capacitance is paired with a fixed frequency control signal generated by a precision clock device, such as a crystal oscillator, which is also temperature and radiation stable. These embodiments fall into a second class of embodiments. In embodiments utilizing both a variable frequency control signal and a variable capacitance, both the variable frequency control signal and the variable capacitance are tunable based on the PVR, which facilitates further compensation of residual instabilities. Such embodiments fall into a third class of embodiments.

FIG. 1 is a schematic diagram of one embodiment of a voltage reference circuit 100. Voltage reference circuit 100 includes a bridge circuit 110 coupled between a reference voltage node, Vref, and ground node. Bridge circuit 110 includes a first branch having a resistor of value R1 and another resistor of value Rref. In the middle of the first branch, between R1 and Rref, is a first intermediate node 120. Bridge circuit 110 also includes a second branch having a resistor of value R1 and a variable resistor of value Rvar. In the middle of the second branch, between R1 and Rvar, is a second intermediate node 130. In certain embodiments, resistors R1 in the first and second branches, and Rref are precision resistors, making them temperature- and radiation-stable.

Bridge circuit 110 also includes an amplifier 140 coupled as a bridge between first intermediate node 120 and second intermediate node 130. Amplifier 140 includes a negative input terminal coupled to first intermediate node 120 and a positive input terminal coupled to second intermediate node 130. Amplifier 140 also includes an output terminal coupled to Vref. In certain embodiments, amplifier 140 includes a plurality of metal-oxide semiconductor field effect transistors (MOSFETs), making amplifier 140 temperature-stable and radiation-stable.

During operation, Vref is divided by the first branch and the second branch based on values of R1 and Rref, and R1 and Rvar, respectively. A voltage Va presents at first intermediate node 120 and a voltage Vb presents at second intermediate node 130. Amplifier 140 operates as a linear error amplifier and generates Vref, which is fed back to the branches, serving as a self-reference for bridge circuit 110. Self-referencing of bridge circuit 110 using amplifier 140 eliminates supply dependence and provides a closed-loop convergence once a startup voltage is applied via a startup circuit (not shown). The startup circuit activates the loop, for example, by raising the voltage Vb at second intermediate node 130 upon power-on. Amplifier 140 is supplied by a substantially non-regulated voltage supply and can be implemented with a power supply rejection (PSR) of at least 100 dB. Furthermore, amplifier 140 operates in the forward path of the closed-loop.

Voltage reference circuit 100 is tuned based on the values of R1, Rref, and Rvar. More specifically, bridge circuit 110 converges on a voltage output, Vref, which is the PVR, based on the value of Rvar relative to Rref. In certain embodiments, the variable resistor of value Rvar is implemented as a switched capacitor resistor with a fixed capacitance C that is alternately charged and discharged through switches controlled by a sinusoidal or square-wave signal having a frequency F. Such embodiments fall into a first class of embodiments. The frequency of the control signal is tuned based on Vref. As frequency increases, Rvar decreases, because the capacitance in the switched capacitor resistor is constant.

In other embodiments, the variable resistor of value Rvar is implemented as a varactor controlled by a stable frequency signal. Such embodiments fall into a second class of embodiments. As the capacitance value C of the varactor increases with Vref, Rvar decreases, because the frequency F operating Rvar is constant. The tunability of switched capacitor resistor Rvar, whether through F or C, facilitates tuning of voltage reference circuit 100 to a steady-state condition where Vref is temperature- and radiation-stable. The steady-state Vref is the desired PVR. In alternative embodiments, R1 is also tunable and may include a switched capacitor resistor similar to Rvar, facilitating further compensation and PVR stabilization.

In certain embodiments, frequency F is variable and tunable based on Vref and capacitance C is fixed, which is referred to as the first class of embodiments. In other embodiments, frequency F is stable and capacitance C is tunable based on Vref, which is referred to as the second class of embodiments. In some embodiments, referred to as a third class of embodiments, both frequency F and capacitance C are variable and tunable based on Vref.

Figure 2:
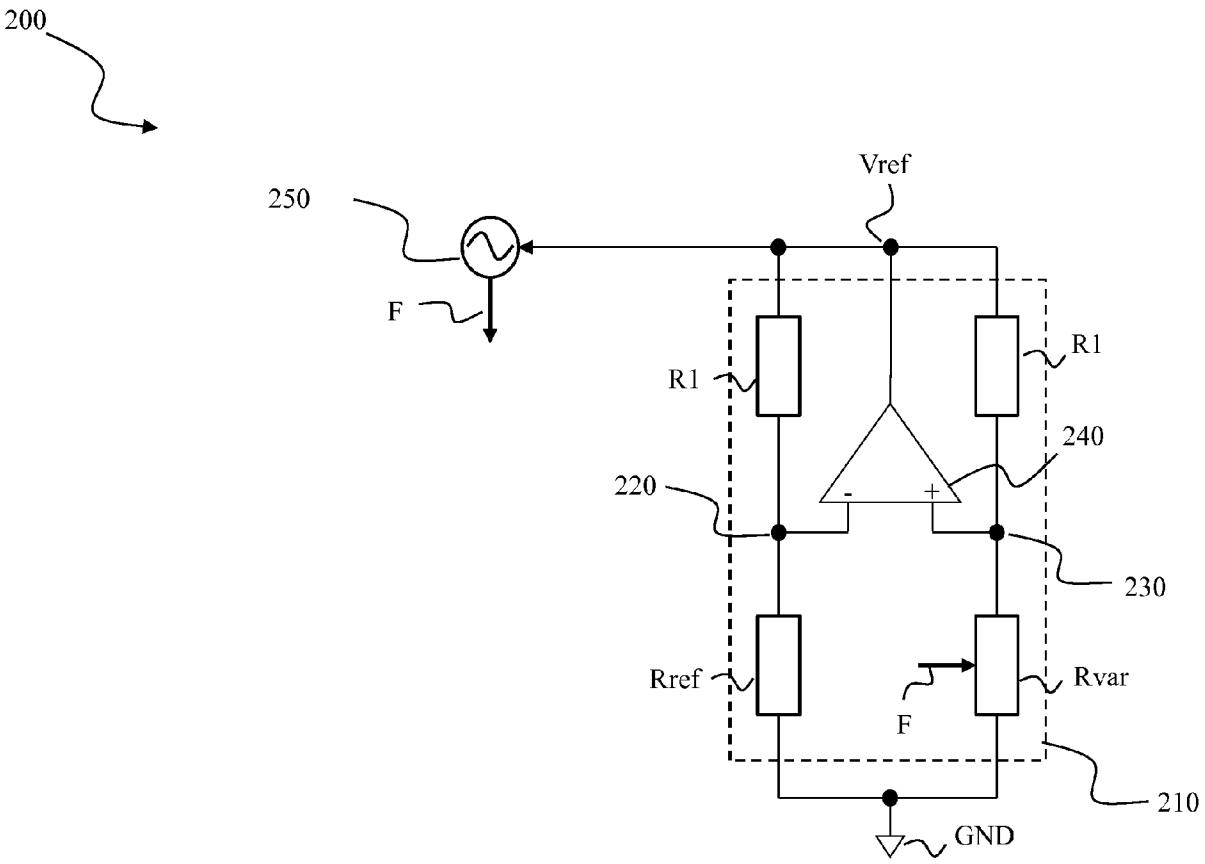
FIG. 2 is a schematic diagram of another embodiment of a voltage reference circuit.

FIG. 2 is a schematic diagram of another embodiment of a voltage reference circuit 200. Voltage reference circuit 200 falls into the first class of embodiments. Voltage reference circuit 200 includes a bridge circuit 210 coupled between Vref and ground, similar to bridge circuit 110 (shown in FIG. 1). Bridge circuit 210 includes resistors R1, resistor Rref, and switched capacitor resistor Rvar (all shown in FIG. 1). Bridge circuit 210 also includes a first intermediate node 220, a second intermediate node 230, and an amplifier 240 coupled between. Bridge circuit 210 operates the same as bridge circuit 110.

Voltage reference circuit 200 further includes a voltage controlled oscillator (VCO) 250. Switched capacitor resistor Rvar is controlled by a periodic signal of frequency F. The periodic signal is generated by VCO 250 at frequency F. Frequency F is tuned based on Vref and capacitance C is fixed. In such embodiments, VCO 250 can be, for example, a relaxation VCO or a differential LC-tank VCO. Voltage reference circuit 200 does not use an external precision clock.

Figure 3:
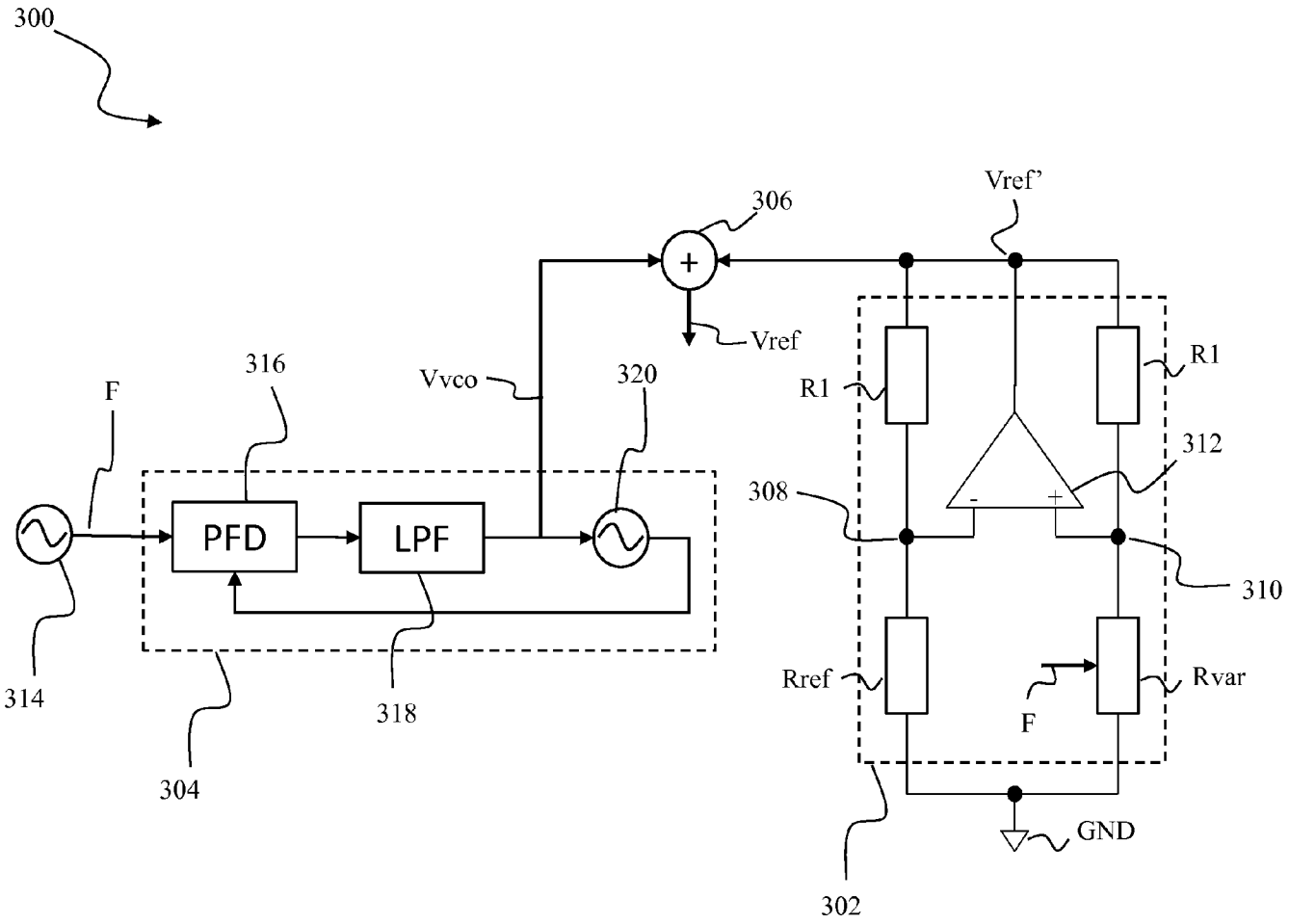
FIG. 3 is a schematic diagram of yet another embodiment of a voltage reference circuit.

FIG. 3 is a schematic diagram of yet another embodiment of a voltage reference circuit 300. Voltage reference circuit 300 falls into the second class of embodiments. Voltage reference circuit 300 includes a bridge circuit 302 coupled between Vref' and ground, similar to bridge circuit 110 (shown in FIG. 1), a phase-lock loop (PLL) circuit 304, and a summer 306. Bridge circuit 302 includes resistors R1, resistor Rref, and switched capacitor resistor Rvar (all shown in FIG. 1). Bridge circuit 302 also includes a first intermediate node 308, a second intermediate node 310, and an amplifier 312 coupled between. Bridge circuit 302 operates the same as bridge circuit 110.

In the switched capacitor resistor, Rvar is implemented as a varactor (not shown) having a variable capacitance C and tunable based on Vref. The switched capacitor resistor is controlled by a periodic signal having a fixed frequency F. The periodic signal is generated by precision clock 314. Precision clock 314, in certain embodiments, includes a crystal oscillator for generating the fixed frequency F periodic signal. In certain embodiments, PLL circuit 304 and summer 306 are omitted and precision clock 314 directly drives the switched capacitor resistor Rvar.

PLL circuit 304 further includes a phase and frequency detector (PFD) 316, a low-pass filter 318, and a VCO 320. VCO 320 is tuned by a varactor of the same type as in the switched capacitance resistor of value Rvar. VCO 320 is configured to generate a sinusoidal signal that is fed back to PFD 316 where it is compared to the periodic signal of frequency F generated by precision clock 314. PLL circuit 304 tunes VCO 320 to emit a sinusoidal signal of frequency F. PLL circuit 304 thereby generates an internal tuning voltage Vvco that compensates for any exogenous variations of the varactors in VCO 320 and the switched capacitor resistor, Rvar, including temperature, radiation, and process corner skew, among others. Tuning voltage Vvco is applied by PLL circuit 304 to VCO 320 to substantially counter the same variations that impact the varactor in Rvar. Therefore, when Vvco is added to Vref' at summer 306, the resulting voltage, Vref, is compensated for such exogenous effects.

In alternative embodiments, tuning voltage Vvco is summed with a voltage Vb at second intermediate node 310 and applied directly to the switched capacitor resistor to tune the varactor of Rvar. In such an embodiment, Vref' is tuned to Vref.

Figure 4:
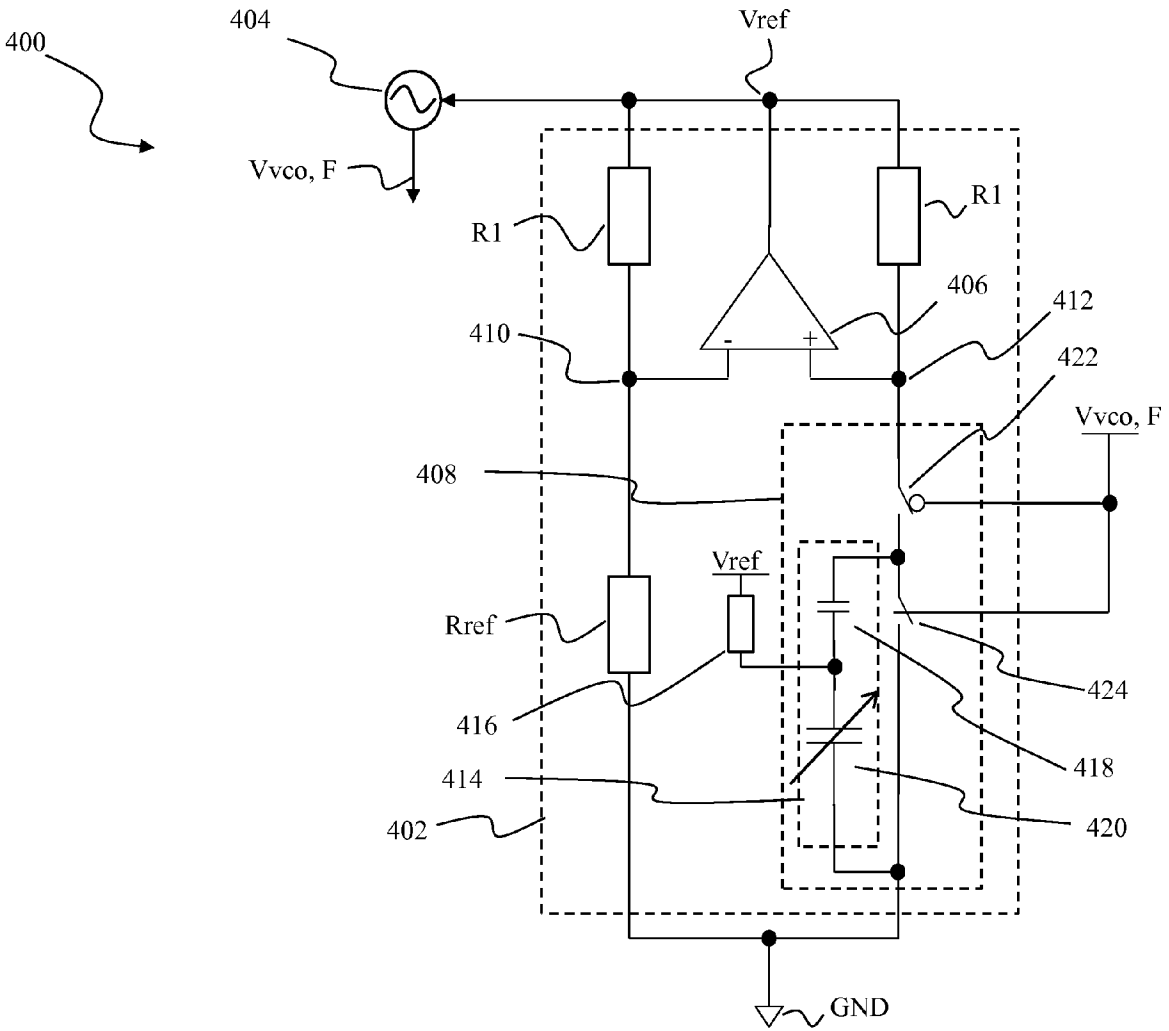
FIG. 4 is a schematic diagram of yet another embodiment of a voltage reference circuit.

FIG. 4 is a schematic diagram of yet another embodiment of a voltage reference circuit 400. Voltage reference circuit 400 falls into the third class of embodiments. Voltage reference circuit 400 includes a bridge circuit 402 coupled between a Vref node and a ground node, similar to bridge circuit 110 (shown in FIG. 1). Voltage reference circuit further includes a VCO 404 configured to generate a voltage output Vvco having a frequency F that is tunable based on Vref.

Bridge circuit 402 includes resistors R1, resistor Rref, and amplifier 406 (all shown in FIG. 1). Bridge circuit 402 also includes a switched capacitor resistor 408 of value Rvar. Bridge circuit 402 also includes a first intermediate node 410 and a second intermediate node 412. Bridge circuit 402 operates the same as bridge circuit 110.

Switched capacitor resistor 408 includes a varactor 414 having two control terminals respectively coupled to the Vref node through a resistive network 416 and the ground node. Varactor 414 has a capacitance C that is tunable by Vref via the control terminals. Varactor 414 includes a constant capacitance 418 and a semiconductor capacitor 420. The capacitance of semiconductor capacitor 420 is tunable by the voltage present across the two control terminals, which depends on voltage Vref. Consequently, the resistance, Rvar, of switched capacitor resistor 408 is tunable based on Vref.

Switched capacitor resistor 408 also includes a switch 422 and a switch 424, each having a control terminal coupled to the output of VCO 404, Vvco. Switch 422 and switch 424, as controlled by Vvco at frequency F, control the charge that moves through varactor 414. As described above, the frequency F of the output of VCO 404 is tunable based on Vref. Consequently, the resistance, Rvar, of switched capacitor resistor 408 is further tunable based on Vref. In certain embodiments, switches 422 and 424 are implemented with MOSFET devices, which can be complementary or not depending on how the driving phases are derived from the oscillation of Vvco. For example, Vvco can be used to generate non-overlapped phases that can be used to drive two N-MOSFETs, rather than an inverter comprised of one N-MOSFET and one P-MOSFET.

In certain embodiments, VCO 404 includes a varactor of the same type as in switched capacitor resistor 408. For example, VCO 404 can be implemented as an L-C tank VCO. By using the same type of varactor, the temperature- and radiation-stability of voltage reference circuit 400 are improved, because variations in Rvar due to temperature or radiation events are further compensated for by the temperature and radiation response of VCO 404.

Figure 5:
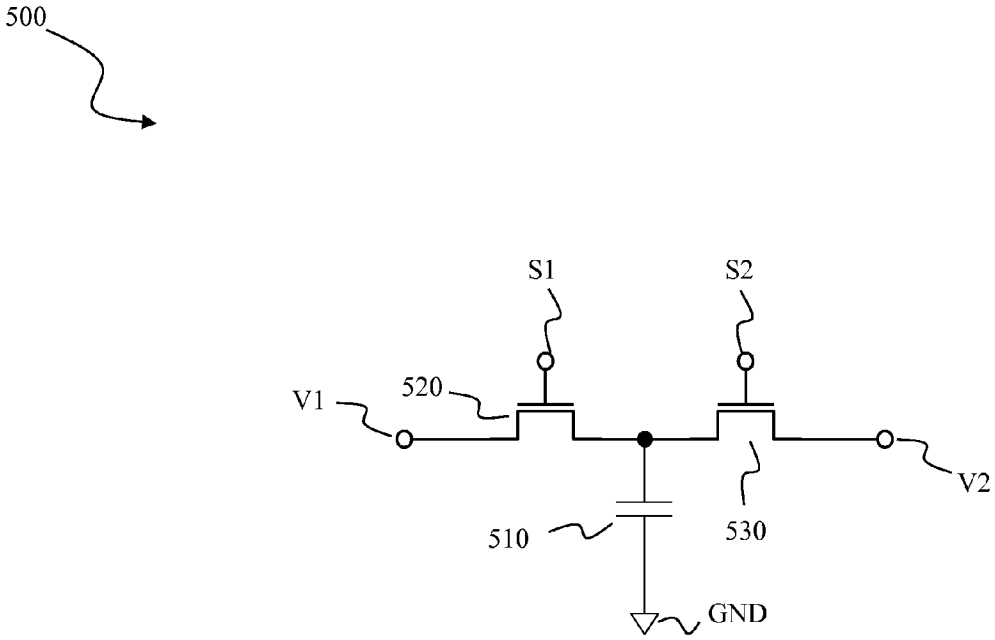
FIG. 5 is a schematic diagram of one embodiment of a switched capacitor resistor.

FIG. 5 is a schematic diagram of one embodiment of a switched capacitor resistor 500 for use in a voltage reference circuit, such as voltage reference circuits 100, 200, 300, and 400 (shown in FIGS. 1-4). Switched capacitor resistor 500 includes a capacitor 510, a first MOSFET 520, and a second MOSFET 530. First MOSFET 520 and second MOSFET 530 are coupled in series, source to drain, between a first terminal V1 and a second terminal V2. First MOSFET 520 and second MOSFET 530 can be NMOS or PMOS devices. In alternative embodiments, first MOSFET 520 and second MOSFET 530 can be replaced by any other suitable switching device, including, for example, relays. Electromechanical relays have an advantage, for example, that they are both more temperature- and radiation-stable than their semiconductor counterparts.

Capacitor 510 is coupled between ground and a node between first MOSFET 520 and second MOSFET 530. First MOSFET 520 and second MOSFET 530 are respectively controlled by a first switch signal 51 and a second switch signal S2, at the respective gates of first MOSFET 520 and second MOSFET 530. First MOSFET 520 and second MOSFET 530 are opened and closed alternatingly. In certain embodiments, first switch signal 51 and second switch signal S2 are implemented as a single periodic signal having a frequency F. For example, in an embodiment having complementary NMOS and PMOS switches, a single periodic signal can control both first MOSFET 520 and second MOSFET 530.

When a voltage, V, is presented at V1, capacitor 510 is charged when first MOSFET 520 is closed and second MOSFET 530 is open. When first MOSFET 520 opens and second MOSFET 530 closes, capacitor 510 discharges, moving the charge to V2, which may be connected to ground, for example. The movement of the charge from V1 to V2 is a current. The amount of current is quantified by the change in charge over a change in time, or $I=dq/dt$, that can be expressed, for a capacitance C and a control signal frequency f, as $I=C\cdot V\cdot f$. Kirchhoff's law, $R=V/I$, permits the resistance of switched capacitor resistor 400 to be expressed as $R=1/(C\cdot f)$. The tunability of capacitance C, frequency f, or both, permits classification of embodiment voltage reference circuits into the first class, the second class, and the third class described above with respect to FIGS. 2-4.

In certain embodiments, capacitor 510 is a fixed capacitance parallel plate capacitor and first MOSFET 520 and second MOSFET 530 are controlled by a variable frequency signal as first switch signal 51 and second switch signal S2. As the variable frequency signal increases in frequency, the resistance of switched capacitor resistor 500 decreases. In certain embodiments, capacitor 510 is a variable capacitance, such as a varactor, and first MOSFET 520 and second MOSFET 530 are controlled by a fixed frequency signal. As the variable capacitance increases, the resistance of switched capacitor resistor 500 decreases. In certain embodiments, capacitor 510 is a variable capacitance, such as a varactor, and first MOSFET 520 and second MOSFET 530 are controlled by a variable frequency signal. Varying both the capacitance of capacitor 510 and the frequency of first switch signal 51 and second switch signal S2 facilitates finer tuning and compensation of the resistance of switched capacitor resistor 500.

In certain embodiments, capacitor 510 is implemented as a varactor on silicon, such as a silicon junction or MOS capacitor. In other embodiments, capacitor 510 is implemented with discrete components, such as one or more relays controlling a varactor. In certain embodiments, capacitor 510 is a varactor implemented using micro-electromechanical systems (MEMS) to form an electrically controlled parallel plate capacitor. In a MEMS varactor, two terminals are used for controlling the separation of the parallel plates by pushing or pulling the plates together or apart. Two other terminals are used as the terminals of the capacitor. A MEMS varactor provides good temperature and radiation stability, because the dielectric and plates are both stable. The MEMS varactor also requires an externally provided control voltage.

Figure 6:
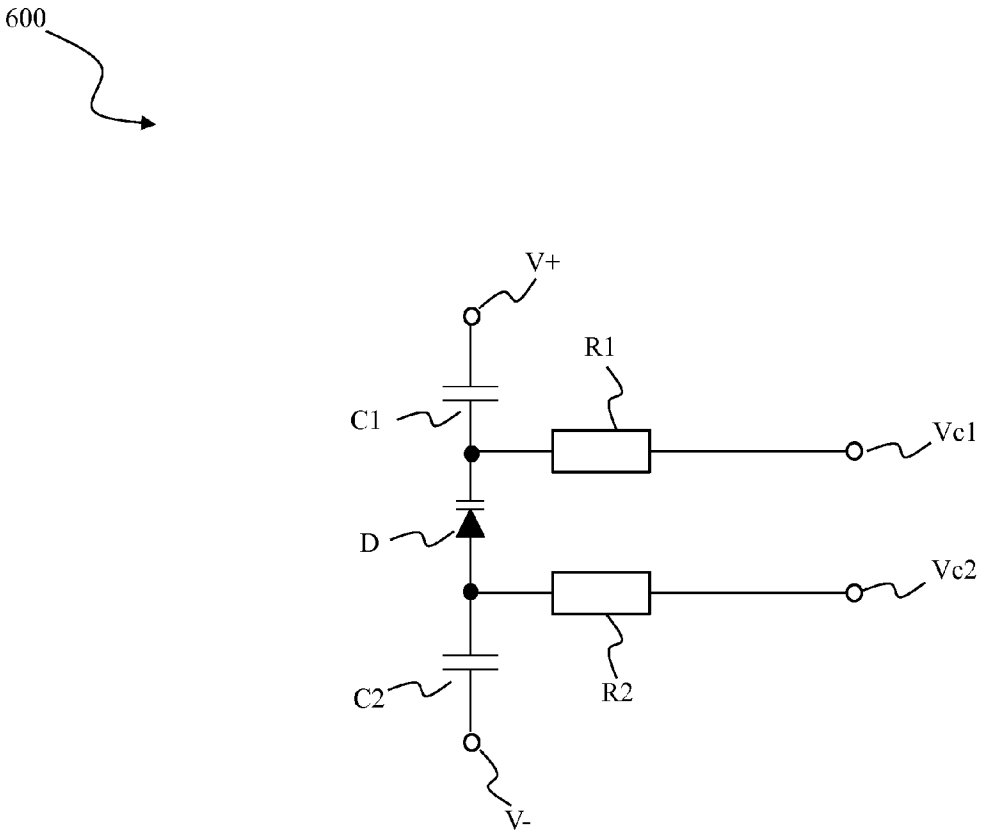
FIG. 6 is a schematic diagram of one embodiment of a varactor.

FIG. 6 is a schematic diagram of one embodiment of a semiconductor varactor 600 for use in a switched capacitor resistor, such as switched capacitor resistor 500 (shown in FIG. 5) and in a capacitance tuned VCO, such as VCO 250 and VCO 320 (shown in FIGS. 2 and 3). Semiconductor varactor 600 includes a constant capacitor C1, a varactor diode D, and a constant capacitor C2 coupled in series between a voltage V+ and a voltage V−. A first control terminal Vc1 is coupled to the cathode of varactor diode D through a resistor R1. A second control terminal Vc2 is coupled to the anode of varactor diode D through a resistor R2. Semiconductor varactor 600 uses the voltage-dependent capacitance of the reversed-biased p-n junction of varactor diode D to tune to a desired capacitance. The combined effects of voltages V+, V−, and voltages applied at Vc1 and Vc2, facilitate tuning semiconductor varactor 600 by transforming a 2-terminal device in varactor diode D into a 4-terminal device in semiconductor varactor 600. In alternative embodiments, semiconductor varactor 600 utilizes a MOS capacitor with a voltage-dependent capacitance.

Figure 7:
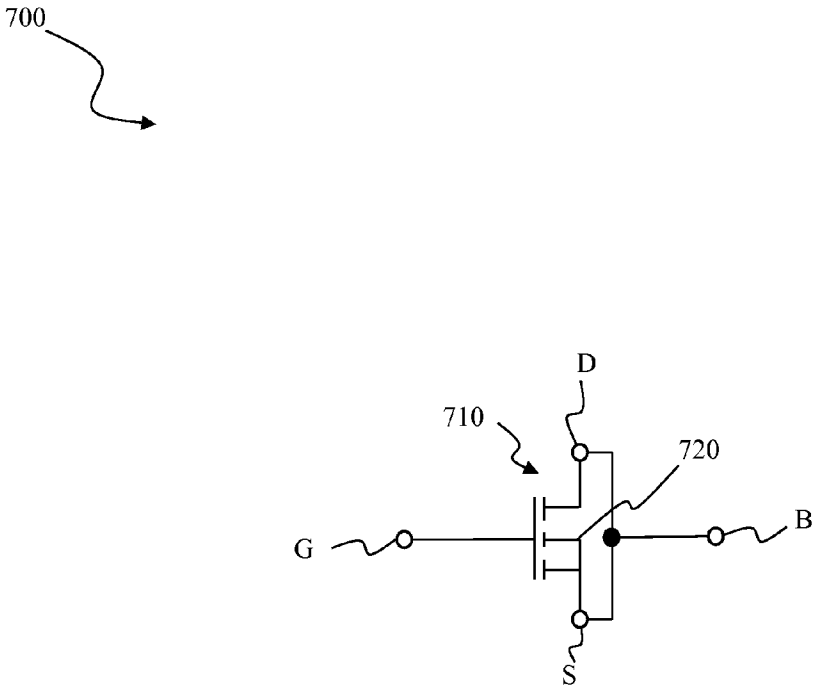
FIG. 7 is a schematic diagram of another embodiment of a varactor.

FIG. 7 is a schematic diagram of another embodiment of a varactor 700 for use in a switched capacitor resistor, such as switched capacitor resistor 500 (shown in FIG. 5) and in a capacitance tuned VCO, such as VCO 250 and VCO 320 (shown in FIGS. 2 and 3). Varactor 700 includes an MOSFET 710 having a gate terminal G, a drain terminal D, a source terminal S, and a body 720. MOSFET 710 is wired as a capacitor by coupling source S and drain D to body 720 and providing a body terminal B. The capacitance of varactor 700 is measured across gate terminal G and body terminal B, and depends on the voltage across those terminals. Body 720 can be implemented with a silicon well of the same or opposite polarity as diffusion/implants of source S and drain D, facilitating operation of MOSFET 710 as a varactor or FET capacitor. MOS varactors provide good radiation stability.

Figure 8:
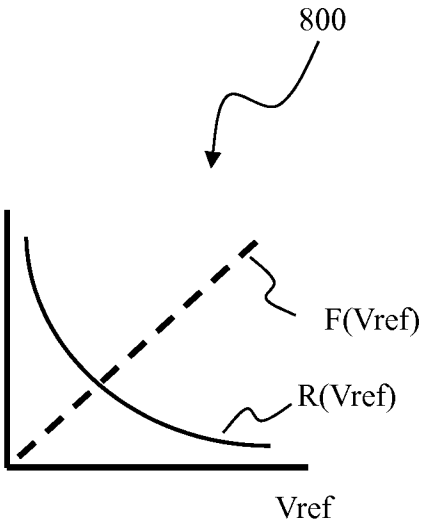
FIG. 8 is a plot of resistance and frequency as a function of a reference voltage for one embodiment of voltage reference circuit.

FIG. 8 is a plot 800 of resistance R and frequency F as functions of a reference voltage Vref for an exemplary voltage reference circuit, such as voltage reference circuits 100, 200, and 400 (shown in FIGS. 1, 2, and 4). More specifically, resistance R is that of a switched capacitor resistor, such as switched capacitor resistor 500 (shown in FIG. 5), and frequency F is that of a sinusoidal signal controlling the switching of first MOSFET 520 and second MOSFET 530. The sinusoidal signal, in certain embodiments, is generated by an external precision clock device, such as a VCO or capacitance-tuned VCO.

Frequency F is tuned monotonically based on voltage Vref. Plot 800 illustrates that F increases linearly with Vref. In alternative embodiments, F may increase non-linearly with Vref. Given the hyperbolic R=1/(C·f) relationship for the switched capacitor resistor, resistance R decreases non-linearly with an increase in Vref.

Figure 9:
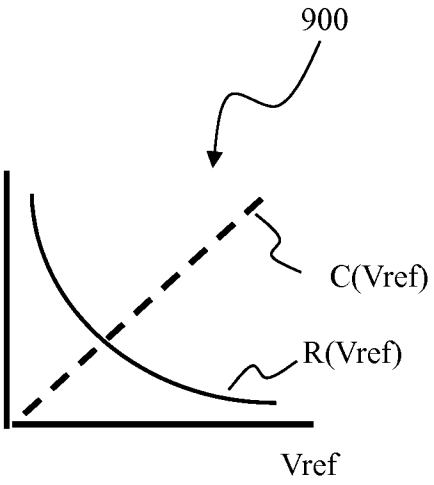
FIG. 9 is a plot of resistance and capacitance as a function of a reference voltage for one embodiment of a voltage reference circuit.

FIG. 9 is a plot 900 of resistance R and capacitance C as a function of a reference voltage Vref for an exemplary voltage reference circuit, such as voltage reference circuits 100, 300, and 400 (shown in FIGS. 1, 3, and 4). More specifically, resistance R is that of a switched capacitor resistor, such as switched capacitor resistor 500 (shown in FIG. 5), and capacitance C is that of a varactor, such as varactor 600 and 700 (shown in FIGS. 6 and 7) for use in switched capacitor resistor 500.

Capacitance C is tuned monotonically based on voltage Vref. Plot 900 illustrates that C increases linearly with Vref. In alternative embodiments, C may increase non-linearly with Vref. Given the hyperbolic R=1/(C·f) relationship for the switched capacitor resistor, resistance R decreases non-linearly with an increase in Vref.

Figure 10:
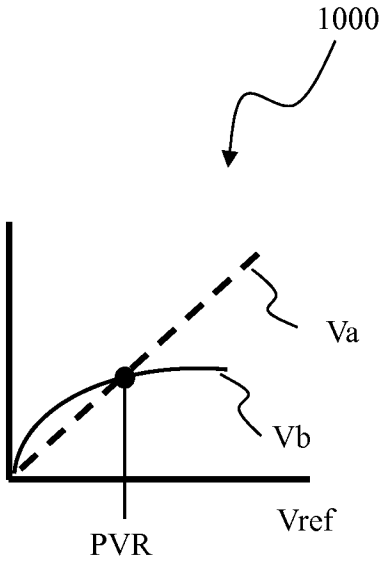
FIG. 10 is a plot of intermediate node voltages for one embodiment of a voltage reference circuit.

FIG. 10 is a plot 1000 of bridge voltages for voltage reference circuit 100, or for voltage reference circuits 200, 300, and 400 (shown in FIGS. 1-4). For a bridge circuit coupled between Vref and ground, such as bridge circuit 110, a voltage Va presents across reference resistance Rref at first intermediate node 120. Va is a result of a constant voltage division of Vref across the first branch having resistance R1 and Rref in series. Similarly, a voltage Vb presents across a switched capacitor resistor having a resistance of Rvar at second intermediate node 130. Vb is a result of a variable voltage division of Vref across the second branch having a resistance R1 and Rvar in series.

Plot 1000 illustrates that voltage Va across Rref increases linearly with Vref. Plot 1000 also illustrates that voltage Vb across Rvar increases non-linearly with Vref. Plots 800 and 900 illustrate the resistance of a switched capacitor resistor varies inversely and non-linearly with capacitance and frequency. In voltage reference circuit 100, frequency, capacitance, or both are tuned based on Vref. Switched capacitor resistor Rvar in bridge circuit 110 likewise varies inversely and non-linearly with Vref. Voltage Vb can therefore be expressed as:

$$Vb = \frac{Vref \cdot R(Vref)}{R1 + R(Vref)}$$

The variation of Vb with decreasing values of R(Vref) diminishes in the segment of Vb illustrated in plot 1000. Amplifier 140 causes bridge circuit 110 to balance voltages Va and Vb, and voltage reference circuit 100 to converge on a single, non-trivial stable Vref, referred to as a PVR, which is illustrated as the intersection of Va and Vb. Convergence on the trivial zero solution is avoided by using a startup circuit to drive the loop of bridge circuit 110 to converge on the non-trivial stable PVR.

Figure 11:
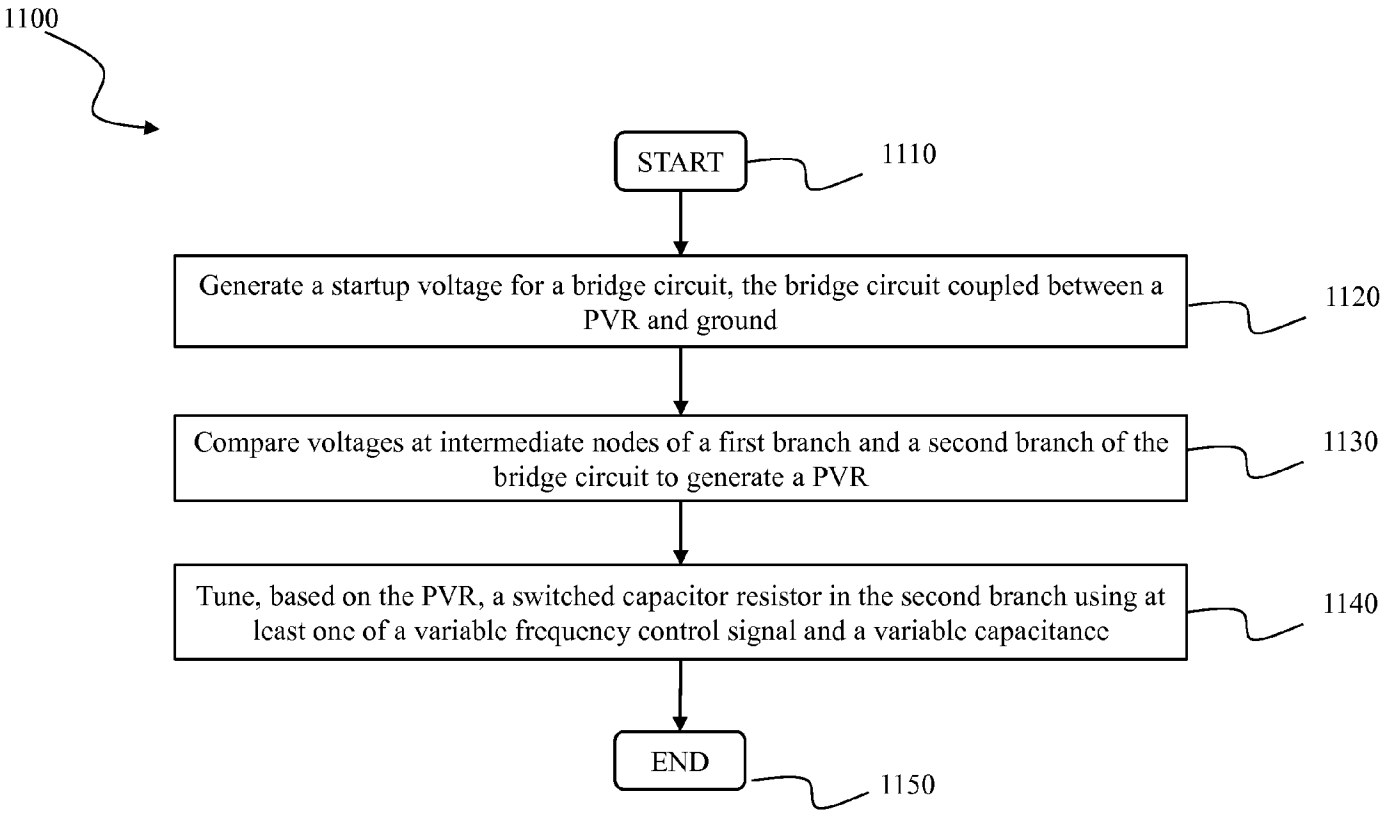
FIG. 11 is a flow diagram of one embodiment of a method of generating a precision voltage reference.

FIG. 11 is a flow diagram of one embodiment of a method 1100 of generating a precision voltage reference. Method 1100 begins at a start step 1110. At a startup step 1120, a startup voltage is applied to a bridge circuit coupled between a Vref node and a ground node, such as bridge circuit 110 (shown in FIG. 1). At a comparing step 1130, voltages at intermediate nodes of the two branches of the bridge circuit are compared, generating a resulting PVR at the Vref node.

At a tuning step 1140, the PVR is used to tune a switched capacitor resistor in the second branch of the bridge circuit. The switched capacitor resistor is tunable by at least one of a variable frequency control signal and a variable capacitance. The tuned resistance of the switched capacitor resistor operates to tune the bridge circuit to the desired PVR. The method ends at an end step 1150.

This written description uses examples to disclose various embodiments, which include the best mode, to enable any person skilled in the art to practice those embodiments, including making and using any devices or systems and performing any incorporated methods. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A voltage reference circuit, comprising:

a bridge circuit coupled between a precision voltage reference (PVR) node and a ground node, the bridge circuit comprising:

a first branch having a first resistor of value R1 coupled to a reference resistor of value Rref at a first intermediate node, a second branch having a second resistor of value R1 coupled to a variable resistor of value Rvar at a second intermediate node, wherein Rvar is non-linearly tunable based on a PVR, and an amplifier having a positive input terminal coupled to the second intermediate node, and a negative input terminal coupled to the first intermediate node, the amplifier configured to generate the PVR.

2. The voltage reference circuit of claim 1 further comprising a voltage controlled oscillator (VCO) tuned based on the PVR and configured to generate a variable frequency signal to control the variable resistor, wherein the variable resistor comprises a switched capacitor resistor having a fixed capacitance of value C.

3. The voltage reference circuit of claim 2, wherein the VCO comprises a relaxation VCO.

4. The voltage reference circuit of claim 2, wherein the VCO comprises a differential LC-tank VCO.

5. The voltage reference circuit of claim 2, wherein the fixed capacitance comprises a parallel plate capacitor.

6. The voltage reference circuit of claim 2, wherein the amplifier comprises a plurality of metal-oxide semiconductor field effect transistors (MOSFETs).

7. The voltage reference circuit of claim 2, wherein the switch capacitor resistor comprises a semiconductor integrated circuit.

8. The voltage reference circuit of claim 1, wherein the variable resistor comprises a continuously-tuned electromechanical potentiometer.

9. The voltage reference circuit of claim 1, wherein the variable resistor comprises a continuously-tuned semiconductor potentiometer.

10. The voltage reference circuit of claim 1, wherein the variable resistor comprises a switched capacitor resistor having a varactor configured to be tuned based on the PVR.

11. The voltage reference circuit of claim 10 further comprising an oscillator configured to generate a stable frequency signal to control the switched capacitor resistor.

12. The voltage reference circuit of claim 11 further comprising a phase-lock loop (PLL) circuit driven by the oscillator and configured to replicate the stable frequency signal, wherein the PLL circuit comprises a voltage controlled oscillator (VCO) tunable based on a second varactor of a same type as the varactor of the variable resistor, and wherein the PLL circuit is configured to generate an output voltage for summing with the PVR.

13. The voltage reference circuit of claim 10, wherein the varactor comprises an electrically-controlled micro-electromechanical system (MEMS) adjustable-plate capacitor.

14. The voltage reference circuit of claim 10, wherein the varactor comprises a metal-oxide semiconductor varactor.

15. The voltage reference circuit of claim 10, wherein the varactor comprises a p-n junction varactor.

16. The voltage reference circuit of claim 10 further comprising a voltage controlled oscillator (VCO) tuned based on the PVR and configured to generate a variable frequency signal to control the switched capacitor resistor.

17. The voltage reference circuit of claim 16, wherein the switched capacitor resistor comprises a first and second metal-oxide semiconductor field effect transistors (MOSFETs) configured to move charge through the varactor.

18. The voltage reference circuit of claim 16, wherein the varactor comprises an electrically-controlled micro-electromechanical system (MEMS) adjustable-plate capacitor.

19. The voltage reference circuit of claim 1 wherein, in the second branch, the second resistor and the variable resistor comprise respective charge pump circuits.

20. A method of generating a precision voltage reference (PVR), comprising:

generating a startup voltage for a bridge circuit, the bridge circuit coupled between the PVR and ground;

comparing voltages at intermediate nodes of a first branch and a second branch of the bridge circuit to generate the PVR; and tuning a switched capacitor resistor in the second branch using at least one of a variable frequency control signal and a variable capacitance, wherein the tuning is based on the PVR.

* * * * *